United States Patent [19]

Kanenwisher

[11] Patent Number: 4,921,251

[45] Date of Patent: May 1, 1990

[54] EDUCATIONAL BASEBALL GAME

[76] Inventor: Albert L. Kanenwisher, 4128 E. 12th, Spokane, Wash. 99202

[21] Appl. No.: 270,364

[22] Filed: Nov. 14, 1988

[51] Int. Cl.[5] ..... A63F 3/00

[52] U.S. Cl. ..... 273/93 R; 273/244; 273/DIG. 26; 116/223

[58] Field of Search ..... 273/93 R, 93 C, 243, 273/244, 247, DIG. 26, 259, 277, 245, 246; 206/315.1; 116/222, 223

[56] References Cited

U.S. PATENT DOCUMENTS

| | | | |
|---|---|---|---|
| 1,113,504 | 10/1914 | Steele | 273/93 R |
| 1,534,390 | 4/1925 | Horton | 273/88 |
| 3,734,501 | 5/1973 | LaMonica | 273/93 R |
| 3,947,039 | 3/1976 | Sadler et al. | 273/247 |
| 4,000,897 | 1/1977 | York | 273/93 C |
| 4,210,335 | 7/1980 | Licciardi | 273/238 |
| 4,230,316 | 10/1980 | Harper | 273/93 R |

*Primary Examiner*—Edward M. Coven
*Assistant Examiner*—Sebastiano Passaniti
*Attorney, Agent, or Firm*—Keith S. Bergman

[57] ABSTRACT

A board game provides a representational baseball field upon which play is conducted pursuant to the contingency determined by a mathematical function of two die, commonly their multiplicative product. The board provides particular scorekeeping apparatus to indicate game condition and necessary information for play. Game play proceeds, upon contingent determinations of batter function, in substantially the same fashion as the play of a ordinary baseball game.

2 Claims, 2 Drawing Sheets

EDUCATIONAL BASEBALL GAME

BACKGROUND OF INVENTION

1. Related Applications

There are no applications related hereto heretofore filed in this or any foreign country.

2. Field of Invention

My invention relates generally to board games and more particularly to such a game simulating baseball wherein batter function is determined by a mathematical function of two randomly determined numbers.

BACKGROUND AND DESCRIPTION OF PRIOR ART

Since Shakespeare's description of Red Mule, and undoubtedly before, board games have been popular in Western culture, originally most probably more as a gambling device than for entertainment. As these games have increased in diversity and sophistication in the course of their development, it has been found desirable to combine with them various secondary functions or purposes to enhance their overall appeal and desirability. This has been especially true in combination of any entertainment type game with some sort of an educational function. The instant invention presents a new, improved and enhanced game of this latter type.

Most board games, and especially those relating to the more popular present-day sports activities, seem to present enhanced aesthetic desirability to younger persons and such games simulating baseball seems to reach the apex of such desirability. As traditional board games require the outcome of some contingent event for their play, this requirement may be conveniently combined with a baseball type game to provide an educational function to synergistically enhance the game's value over either its entertainment or educational function individually.

My invention uses the numerical values on the exposed faces of two die to determine a contingent event, but it functionally relates those numbers determined by each die to determine a result upon which game play is based. In board games heretofore known that have used two die to determine play, some type of mathematical functional relationship of the numbers determined from the exposed faces of those dice must necessarily be used. In general this function heretofore used has been an additive one. My invention uses the multiplicative function and may use the subtractive or divisional function to determine a contingent result for game play. It is distinguished from the prior art in the manner in which numbers are functionally determined and related to game play.

Though various baseball type games have heretofore become known, they have not closely simulated play of an actual baseball game, but yet the desirability of the board game seems to depend rather directly upon the closeness of the game's simulation to an actual baseball game. My invention seeks to provide this closeness of simulation, as far as possible, while yet maintaining the essence of a basic board game and is distinguished from other members of the prior art in so doing.

My game apparatus further provides a novel compound indicator structure of substantial durability for use especially by younger persons that yet provides necessary information required for the play of my game. It provides plural rotary dial-type indicator devices to display all parameters of play to determine the status of a baseball game at any point during its play, whereas prior art devices have in general required such information to be maintained either by ancillary devices not a part of the game apparatus itself or by the mental activity of a player, possibly as memorialized on a piece of paper with some sort of a marker.

My invention resides not in any one of these features per se, but rather in the synergistic combination of all of the structures of my invention that give rise to the functions necessarily flowing therefrom, as hereinafter specified and claimed.

SUMMARY OF INVENTION

My invention provides a casement carrying a game board, plural rotating dial scorekeeping apparatus to indicate game parameters, and other playing pieces. The dials provide concentric, relatively movable, larger and smaller disks to indicate either a two digit parameter or two one digit parameters. The face of the game board defines a simulated baseball field with a group of numbers, representing some but not all of the possible multiplicative products of the numbers indicated by the exposed faces of two ordinary die, associated with each of the nine player positions on a baseball field.

To play the game a batting order of players is determined and the dice thrown sequentially for each player to represent his batting function. The two die are thrown up to four times for each batter position. If one of three possible numbers is matched by the functional relationship of the numbers indicated by the dice on the first throw, the batter and all players on base advance four bases; if a number is matched on the second throw, all involved players advance three bases; if a number is matched on the third throw, all involved players advance two bases; and if a number is matched on a fourth throw, all involved players advance one base. If none of the three numbers associated with a player's position is matched in four dice throws, the player is out. Two additional numbers are included in each number array associated with a player to, if matched, indicate an error or a strike out respectively. Play proceeds through each position in a batting order sequentially according to the normal play of an ordinary baseball game and after nine innings of play, the team with the highest score is the winner. Player markers are moved about the bases indicated on the playing board to indicate player position at any particular point of play, and other game parameters are indicated by the rotating dials.

In providing such a game, it is:

A principal object of my invention is to provide a board game simulating an actual baseball game that is played pursuant to a contingency determined by the mathematical multiplicative function of the exposed faces of two ordinary thrown die.

A further object of my invention is to provide such a game that allows four chances to match three of the possible multiplicative products of two ordinary die to responsively move a base runner on bases and allows one other possible multiplicative product to determine a strike out and one third possible multiplicative product to indicate an error.

A further object of my invention is to provide a board for such a game that has associated compound disk indicators to display parameters and conditions of play at all times.

A still further object of my invention is to provide such a game that has a board with a simulated baseball field upon it to keep track of player positions during their batting and base occupying periods by means of markers maintained on the board.

A still further object of my invention is to provide such a game that is of new and novel design, of rugged and durable nature, of simple and economic manufacture and otherwise well adapted to the uses and purposes for which it is intended.

Other and further objects of my invention will appear from the following specification and accompanying drawings which form a part of this application. In carrying out the objects of my invention, however, it is to be remembered that its accidental features are susceptible of change in design and structural arrangement with only one preferred and practical embodiment being specified as is required.

BRIEF DESCRIPTION OF DRAWINGS

In the accompany drawings which form a part hereof and in which similar numbers of reference refer to similar parts throughout.

DESCRIPTION OF THE PREFERRED EMBODIMENT

My invention generally provides rectilinear casement 10 carrying game board 11, scorekeeping apparatus 12 and playing pieces 13.

Figure 6:
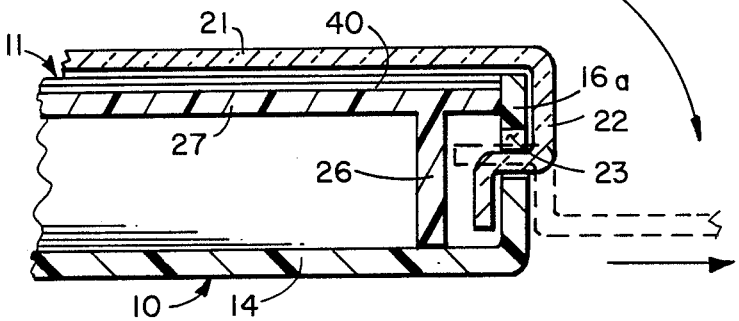
FIG. 6 is an enlarged partial cross-sectional view through the fastening structure and the cover element, taken on the lines 6—6 on FIG. 1 in the direction indicated by the arrows.

Casement 10 provides a relatively flat five-sided, opentop box formed by bottom 14, similar upstanding sides 15 and similar upstanding ends 16 all structurally joined at their adjacent edges. The interior of the box is divided by various septa 45 into a game board area 17, instruction carrying area 18, scorekeeping area 19 and playing piece storage area 20. Top 21 forms a removable cover for the container structure to enclose it. The top provides rearward depending portion 22 of "S" shaped cross-section that interfits in slot 23 defined in the rearward side **16*a* of the casement structure so that the top releasably interfits and moves in the pivotal fashion as illustrated by the dotted outline in FIG. 6 for removal. The forward portion of the top provides depending lip 24 which fits outwardly adjacent the outer surface of the upper portion of the forward side 16*b* where it is releasably maintained by resiliently deformable "C" clamp 25** configured to be positionable with its arms extending over both the bottom surface of the container and the upper surface of the top element to positionally maintain these elements. This closable top structure provides an enclosable container for the game and its parts for storage during periods of non-use and even for merchandising.

Figure 4:
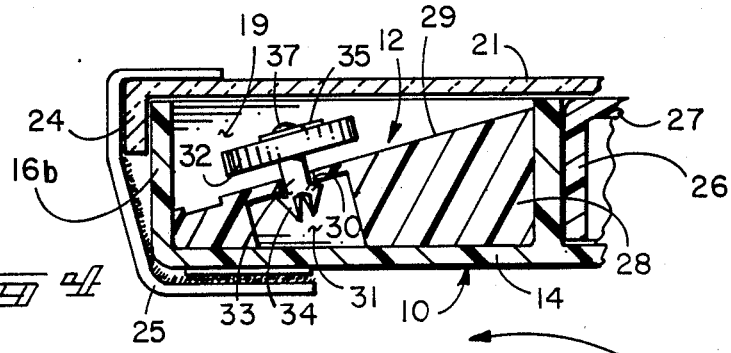
FIG. 4 is a somewhat enlarged, partial cross-sectional view through the scorekeeping dial structure of FIG. 1, taken on the line 4—4 thereon in the direction indicated by the arrows.

Both the instruction area and game board area of casement 10 carry only relatively thin elements and therefore have upturned box-like supports formed with depending vertical sides 26 supporting planar tops 27 configured to support an instruction sheet or game board at approximately the level of the upper edges of upstanding sides and ends of the casement, as illustrated in FIG. 4. All of these elements of the casement are formed of some reasonably rigid and durable material, preferably a polymeric or resinous plastic. Preferably the top element at least is formed of such a material of transparent nature so that the contents of the casement may be observed through the top element when that element is in place on the casement.

Figure 1:
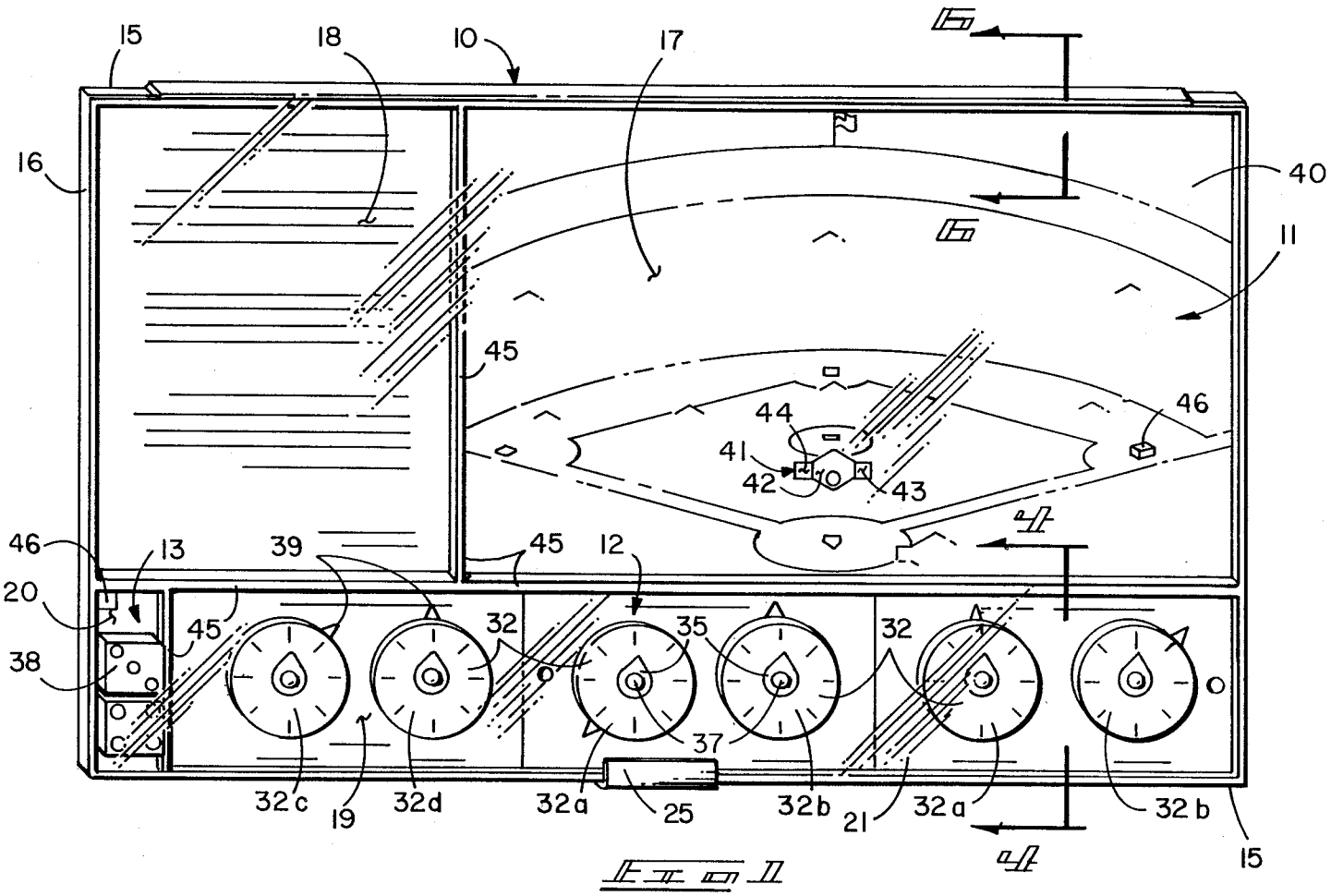
FIG. 1 is an orthographic top or plan view of my game apparatus in its casement showing its parts, their configuration and relationship.
Figure 2:
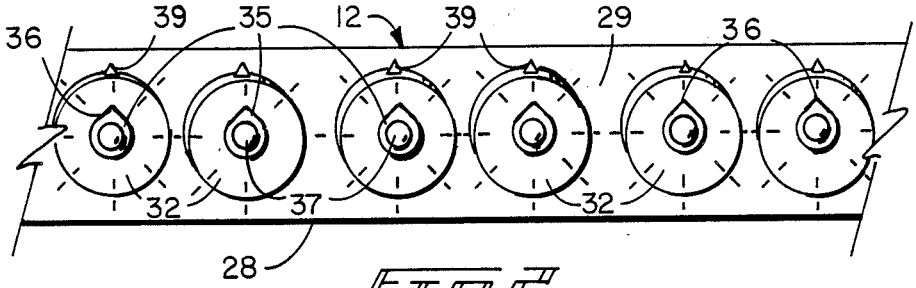
FIG. 2 is a partial orthographic top view of the scorekeeping dials of my invention.

Scorekeeping apparatus 12 is kept in the elongate scorekeeping area 19 defined in a portion of casement 10 immediately inwardly adjacent its forward edge, as shown in FIG. 1. This area carries support base 28, of a vertical thickness not greater than the height of septa 45, defining forwardly and downwardly angulating top surface 29 defining plural disk holes 30 spaced along a line in its medial portion. Beneath each disk hole is defined an expansion chamber 31, somewhat larger than the communicating disk hole, to allow placement and expansion of a fastening portion of a disk supporting shaft.

Figure 3:
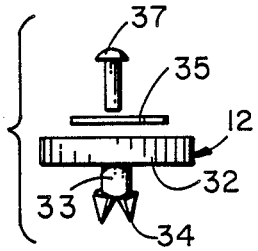
FIG. 3 is an expanded orthographic side view of one of the compound scorekeeping dial structures.
Figure 5:
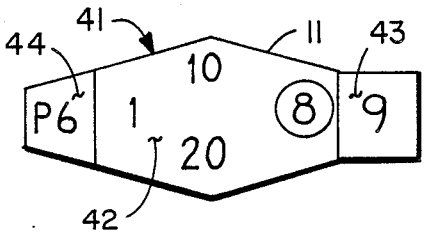
FIG. 5 is an enlarged view of one of the player number boxes associated with each player position.

Each scorekeeping indicator provides base disk 32 structurally carrying an axially aligned depending mounting shaft 33 which defines an internal channel to receive a mounting pin in the upper portion thereof and plural pointed mounting feet having an upper diameter somewhat larger than the diameter of the mounting shaft 33 but tapering radially inwardly in a downward direction, to aid insertion through and releasable fastening in disk hole 30, as illustrated in FIG. 3. The diameter of mounting shaft 33 above fastening feet 34 is such as to allow frictional rotary motion of the shaft in one of disk holes 33 defined in support base 28 and the distance between the lower portion of the base disk and the upper portion of the fastening feet is substantially the same as the thickness of the element defining disk hole 33 so that a base disk may be rotatably carried within that disk hole in a releasable and positionally maintainable fashion. Each base disk has some indicia to index a particular radial position, in the case indicated a pointer device 39 projecting from the periphery.

Indicator disk 35, carried immediately above base disk 32, provides pointer structure 36 to define an indexing indicator and a medial hole to rotatably receive mounting pin 37 which is releasably carried in the medial channel defined in mounting shaft 33. With this assemblage, base disks 32 are carried in support base 28 preferably with some friction to maintain rotary position once established, but yet allow rotary positioning by manual manipulation and indexing disk 35 is similarly pivotable relative to the base disk.

Numbers (not shown) are positioned on top 29 of support base 28, about the periphery of each base disk, and upon the base disks themselves immediately inwardly adjacent their peripheries to indicate two separate numerical elements concerning scorekeeping. These indicators show total runs for each team on disks **32*a*, the particular inning of play for each team on indicators 32*b*, the number of dice throws of a player on disk 32*c*, and the number of outs of a particular team on disk 32*d*. Some of these disks obviously do not require double digit numbers to indicate the information required of them and in that case, there is no need for use of the indicating disk 35 unless it be otherwise aesthetically desired for overall similarity of elements. These various disks 32** are manually manipulated by the players to the particular desired positions to indicate a particular game condition and serve merely as memorializing devices for a game's status at a particular point of play.

Playing pieces 13 comprise two or more dice 38 and four base runner markers 46. Dice 38 are of the ordinary variety of commerce with six faces bearing indicia indicating six numbers, in the simplest case the numbers one through six. Markers 46 may be any type of physical indicator that is movable about the bases to indicate the runner position at a particular time. Preferably all of the markers and dice are containable in playing piece storage area 20.

Game board 11 provides flat rigid sheet-like base 40 presenting an image of an ordinary baseball diamond on its upper face. This diamond at each player position provides a number box 41 defining a larger medial portion 42 and two smaller side portions 43, 44. Side portion 44 contains a number indicating the number of the particular player according to normal baseball terminology, with the pitcher being player one, the catcher player two, etc. Side portion 43 and the middle portion 42 contain, respectively, one and four numbers indicating possible multiplicative products of the numbers on the exposed faces of dice 38. Each of the number boxes 41 is located substantially where the particular players represented normally would play on an ordinary baseball field and the home plate and three bases are represented by a symbol in the appropriate position each would occupy on a baseball field. One of the numbers in middle portion 42 has a circle around it to distinguish it from the other three numbers in that portion of the number box for purposes hereinafter described concerning the play of the game.

It is to be noted that if two dice each having six faces indicating the numbers one through six are used in play of my game the numbers in the number boxes will collectively represent all of the possible unique multiplicative products of the dice numbers. If more dice or other numbers be used, however, this may not be the case and all possible multiplicative products may not be represented on the game board. The game may be played in either fashion, but its play is obviously more simple in the former than in the latter case.

Having described my game apparatus, the play of my game may be understood.

My game normally will be played by two players and the order of play will be determined by some random event, such as the highest number resulting on the throw of the dice. The player determined to play first will represent the visiting team and the player to play second will represent the home team.

The play proceeds in the batting order arbitrarily established by the game player representing each team. For each baseball player the dice of the game are thrown up to four times and the multiplicative products of the numbers derived from each of such throw are determined by the mental activity of the particular game player. If on any throw for a particular baseball player the encircled number in middle portion 42 of the number box for that player is matched, the player is out, as in the case of a throw-out or a caught fly in an actual baseball game. If on any throw of the dice the multiplicative product matches the number in side portion 43, the batter takes first base and any other players then on the bases advance one base as in the case if an error or passed ball in an actual baseball game. If neither of the foregoing events occur, on the first throw of the dice for a particular player position, if one of the three numbers in middle portion 42 of the player box that are non-encircled are matched by the multiplicative product of the numbers represented by the die faces, this constitutes a home run; if on the second throw one of the three non-encircled numbers in portion 42 of the player's number box is matched by the product, this constitutes a triple; if on the third throw one of the non-encircled numbers in portion 42 of the player's number box is matched by the product, this constitutes a double; and if on the fourth throw one of the non-encircled numbers in portion 42 of the player's number box is matched by the product, this constitutes a single. If none of the non-encircled numbers in the middle portion of a player's number box is matched by the multiplicative product resulting in four throws of the dice, the particular player is out, as on a strike out, throw out or caught fly ball.

With play for each player in a batting order determined sequentially in such fashion, the play of the game proceeds substantially in the same fashion as in an actual baseball game. Each player in turn in the visiting team's batting order has his fate determined as aforesaid according to throws of the dice and play is continued by a player representing that team until there have been three outs for that team to determine one-half of an inning. The position of runners during play is indicated by the positioning of markers 46 on the various base positions defined on the board.

After one team has three outs, the game player representing the other team "comes to bat" and his play proceeds according to his predetermined batting order in the same fashion as previously described. The game proceeds in this manner through the course of a predetermined number of innings, traditionally but not necessarily nine, and the player having the highest score at the end of those innings of play is the winner. If there is a tie score at the end of nine innings, play proceeds in the traditional fashion of a baseball game until one side or the other has at least one additional score at the end of a particular inning.

During play, the various parameters of scoring are indicated by the scorekeeping apparatus. To do this, the base dials and indicating disks of the various scorekeeping sets are manually manipulated by the players to indicate the proper numeric representation of the particular parameter being determined and obviously these determinations will continuously vary throughout the game play in the normal fashion of an actual baseball game. During play the nonplaying person, representing the team that is not at bat, serves as an umpire to determine that the player representing the team at bat functions properly in the course of his play and preferably the dials of the scorekeeping apparatus will be manipulated by that umpiring player.

It is to be particularly noted from the foregoing description of game play that a player must necessarily make a mental computation to determine the multiplicative product of numbers determine by the exposed faces of the dice, and this provides an educational feature with the game itself providing incentive for its performance. The particular multiplicative process applies not only to the player affirmatively involved during the play, but also to his adversary who is umpiring to determine if the player whose team is at bat is performing his playing functions properly. The game thusly provides an educational device for teaching the multiplication of numbers for both players. It is to be further noted that the faces of the dice in question might be more or less than six and may represent numbers other than the traditional numbers of one through six on most dice, if desired, to make the multiplicative process more complex and game play more difficult.

It is further to be noted that my game provides play that constitutes a very close simulation to an actual baseball game with most of the play functions following traditional rules and regulations of a baseball game as presently known. This provides substantial realism to play of the game to give enhanced aesthetic appeal, especially for young persons or others interested in the game of baseball.

The foregoing description of my invention is necessarily of a detailed nature so that specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent and what I claim is:

1. A method for playing a baseball simulating game utilizing apparatus having a peripherally defined casement formed as a five-sided flat box with septa subdividing a game board area carrying a game board defining a likeness of a baseball field and having a number box associated with each player positioned on the field, said number box having a first larger portion carrying four numbers, one of which is encircled, and a second smaller portion carrying one number, all said numbers constituting a multiplicative product of numbers carried on the faces of at least two dice, and said scorekeeping area carrying scorekeeping apparatus including a plurality of score indicating elements, comprising the steps of:

determining a sequential batting order for two teams and each of nine possible baseball players, determining the order of play of the two teams, throwing dice up to four times for each batting player and determining the multiplicative product of the numbers indicated by the dice;

matching the multiplicative products so obtained with the numbers in the number box associated with a batting player to determine the disposition of the batting player;

continuing play in a similar fashion for each batting player in sequential order according to the play of an actual baseball game until at least nine innings have been played and one team has a score greater than the other at the end of the last inning.

2. The invention of claim 1 further characterized by:

terminating play of an individual batting player if the encircled number in the number box associated with the batting player is matched on any throw;

advancing the batter and any players on base by one base if the number in the smaller portion of the number box is matched on any throw;

advancing the players four bases if any one of three uncircled numbers in the first larger portion of the number box associated with the batting player is matched on the first dice throw;

advancing the players three bases if any one of said three uncircled numbers in the first larger portion of the number box associated with the batting player is matched on the second dice throw;

advancing the players two bases if any one of the immediately aforesaid group of three uncircled numbers is matched on the third dice throw;

moving the players one base if one of the three uncircled numbers from the immediately aforesaid group of three numbers is matched on a fourth throw;

terminating play for an individual player if no numbers associated with a particular player number box are matched upon four dice throws.

* * * * *